US005522233A

United States Patent [19]

Nares et al.

[11] Patent Number: 5,522,233

[45] Date of Patent: Jun. 4, 1996

[54] MAKEUP OIL SYSTEM FOR FIRST STAGE OIL SEPARATION IN BOOSTER SYSTEM

[75] Inventors: Terry Nares, Syracuse; Steven J. Holden, Manlius, both of N.Y.

[73] Assignee: Carrier Corporation, Syracuse, N.Y.

[21] Appl. No.: 360,874

[22] Filed: Dec. 21, 1994

[51] Int. Cl.[6] ..... F25B 31/00; F04B 39/04

[52] U.S. Cl. ..... 62/193; 62/470; 62/510; 417/228

[58] Field of Search ..... 62/510, 193, 84, 62/470, 199; 417/228

[56] References Cited

U.S. PATENT DOCUMENTS

| | | | |
|---|---|---|---|
| 3,719,057 | 3/1973 | Grant | 62/193 |
| 4,947,655 | 8/1990 | Shaw | 62/510 X |
| 5,016,447 | 5/1991 | Lane et al. | 62/470 |

*Primary Examiner*—William E. Wayner

[57] ABSTRACT

In a system having low and high stage compressors with an oil separator downstream of each stage there can be a tendency for oil from the first stage to collect in the second stage. So, responsive to a low level of oil in the first stage oil system, oil is supplied from the second stage oil system to the first stage oil system.

3 Claims, 2 Drawing Sheets

MAKEUP OIL SYSTEM FOR FIRST STAGE OIL SEPARATION IN BOOSTER SYSTEM

BACKGROUND OF THE INVENTION

There is an affinity between lubricants and the refrigerants they are used in association with. In addition to the affinity resulting in the presence of lubricant in the refrigerant, additional lubricant is often entrained in passage of the refrigerant through a compressor as a byproduct of compressor lubrication. Commonly, an oil separator is located downstream of a compressor and serves to remove lubricant from the refrigerant with the lubricant being returned to the compressor. Since oil separators are not 100% efficient, some lubricant will get into the system whether or not an oil separator is used. Eventually, oil from the system will be returned to the compressor but there will be some oil "lost" in the system and this is normally addressed in the initial lubricant charge.

Problems can arise where oil discharge from the compressor is not eventually returned to the compressor. One source of such oil loss can be the use of staged compressors with oil separators at the end of each stage. In this case oil passing from the first stage oil separator may be separated out in the second stage oil separator and delivered to the oil reservoirs of the second stage compressors. Actually, any type of oil loss scenario could result in a transfer of oil from the first stage oil system to the second stage.

SUMMARY OF THE INVENTION

In a system having low and high stage compressors with an oil separator downstream of each stage, two oil level floats are utilized in the mid-stage oil system, one in the oil reservoir to be used for oil level safety. The second oil level float will be installed in the mid-stage oil separator itself and will be used to provide the control signal for the oil makeup solenoid. On a decrease in separator oil level, the float switch contacts will open thereby signaling a delay on break relay to immediately open the solenoid which will allow oil to flow to the mid-stage separator from the high stage separator. Once the level in the mid-stage separator increases such that the float contacts close, the time delay of the relay will hold the solenoid open for a defined period of time. This will to avoid short cycling of the solenoid valve. The high stage oil reservoir will be of sufficient capacity to adequately supply lubrication to the high stage compressors as well as makeup oil to the mid-stage oil system when necessary. Excess capacity in the high stage oil reservoir should be at least 50% of the mid-stage oil reservoir capacity.

It is an object of this invention to control the system oil charge in screw compressor booster applications.

It is another object of this invention to maintain an adequate oil level in the mid-stage oil separation system of a booster compressor refrigeration system.

It is an additional object of this invention to maintain adequate oil for lubrication of the compressor bearings anti sealing of the compressor rotors on the low stage compressors. These objects, and others as will become apparent hereinafter, are provided according to the teachings of the present invention.

Basically, responsive to a low level of oil in the mid-stage oil system, oil is supplied from the high stage oil separator system to the mid-stage oil system.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
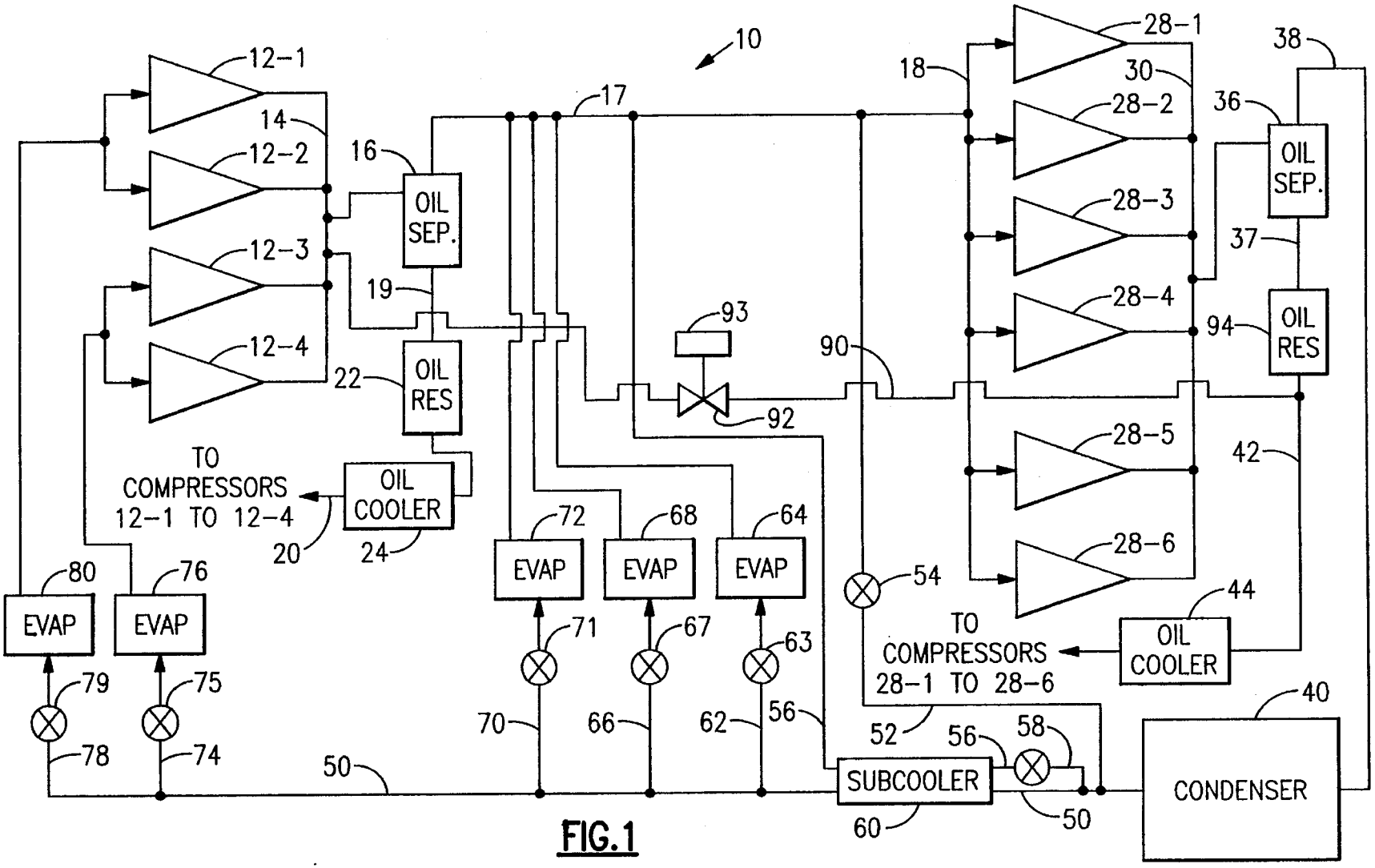
FIG. 1 is a schematic representation of a booster screw compressor refrigeration system.

In FIG. 1, the numeral 10 generally designates a booster screw compressor system exemplified by a commercial refrigeration system such as are employed in supermarkets. First or low stage bank compressors 12-1 to 12-4 discharge into common discharge manifold 14 which is connected to the inlet of oil separator 16. Refrigerant from which oil is removed passes from the outlet of oil separator 16 via line 17 to common inlet manifold 18 of the second or high stage bank compressors. Oil separated from the refrigerant in oil separator 16 passes via line 19 to oil reservoir 22 and via oil cooler 24 and line 20 back to the compressors 12-1 to 12-4 of the first or low stage bank.

Second or high stage bank compressors 28-1 to 28-6 are connected by a common inlet manifold 18 from which they receive pressurized refrigerant which is further compressed and delivered to common outlet manifold 30. Pressurized refrigerant delivered to outlet manifold 30 enters oil separator 36 which has an oil reservoir integral therewith. Refrigerant from which the oil is removed passes via line 38 from the outlet of oil separator 36 to condenser 40. Oil separated from the refrigerant in oil separator 36 and collected in the reservoir therein passes via line 37 to oil reservoir 94 and via line 42 and oil cooler 44 back to the compressors 28-1 to 28-6 of the second or high stage bank.

Flow from condenser 40 via line 50 can take a number of paths to line 17 connecting the first and second stages and to the compressors 12-1 to 12-4 of the first or low stage bank. Flow from line 50 passing through line 52 is expanded by expansion device 54 and delivered to line 17 where it mixes with and cools the refrigerant in line 17 prior to its being supplied to inlet manifold 18 and compressors 28-1 to 28-6. The flow in line 50 which is not diverted through line 52 is supplied to subcooler or economizer 60 via line 50 and via a diverted flow through line 56 which has an expansion device 58. Liquid refrigerant passing through line 56 is expanded by expansion device 58 and the expanded refrigerant flows into the subcooler or economizer 60 where it cools the liquid refrigerant flowing in line 50 before being supplied to line 17 where it mixes with and cools the mid-stage refrigerant in line 17 prior to its being supplied to inlet manifold 18.

Flow from subcooler 60 via line 50 is supplied via lines 62, 66, 70, 74 and 78 to evaporators 64, 68, 72, 76 and 80. Flow in lines 62, 66 and 70 is expanded by expansion devices 63, 67 and 71, respectively, before being supplied to evaporators 64, 68 and 72, respectively. Evaporators 64, 68, and 72 are located in coolers such as those for milk, dairy products and meats which keep the food at temperatures above freezing. Flow from evaporators 64, 68 and 72 is supplied to line 17 where it mixes with the interstage refrigerant. It should be noted that refrigerant supplied to line 17 via lines 52, 56, 62, 66 and 70 does not go back to the first or low stage compressors 12-1 to 12-4 and, accordingly, any oil returning from the system via the flowing refrigerant is not brought back to the first or low stage compressors 12-1 to 12-4.

Flow in line 74 is expanded in expansion device 75 and supplied to evaporator 76 which is located in an ice cream cooler and is then supplied to compressors 12-3 and 12-4. Similarly, flow in line 78 is expanded in expansion device 79 and supplied to evaporator 80 which is located in a frozen food case and is then supplied to compressors 12-1 and 12-2. The flow in lines 74 and 78 will bring some oil back to compressors 12-1 to 12-4 but there is a net loss from compressors 12-1 to 12-4 in the system described so far. If there is a loss of oil in one part of the system 10 it is obvious that there is a gain in another part of the system, specifically the second or high stage bank. Line 42 which connects oil reservoir 94 and oil cooler 44 is connected therebetween with line 90. Line 90 connects between line 42 and manifold 14 and contains normally closed solenoid valve 92 having an actuator 93. Because oil reservoir 94 and line 42 are at second stage discharge pressure, while manifold 14 is at mid-stage pressure, oil from oil reservoir 94 would tend to flow into manifold 14 due to the pressure differential but for valve 92.

Figure 2:
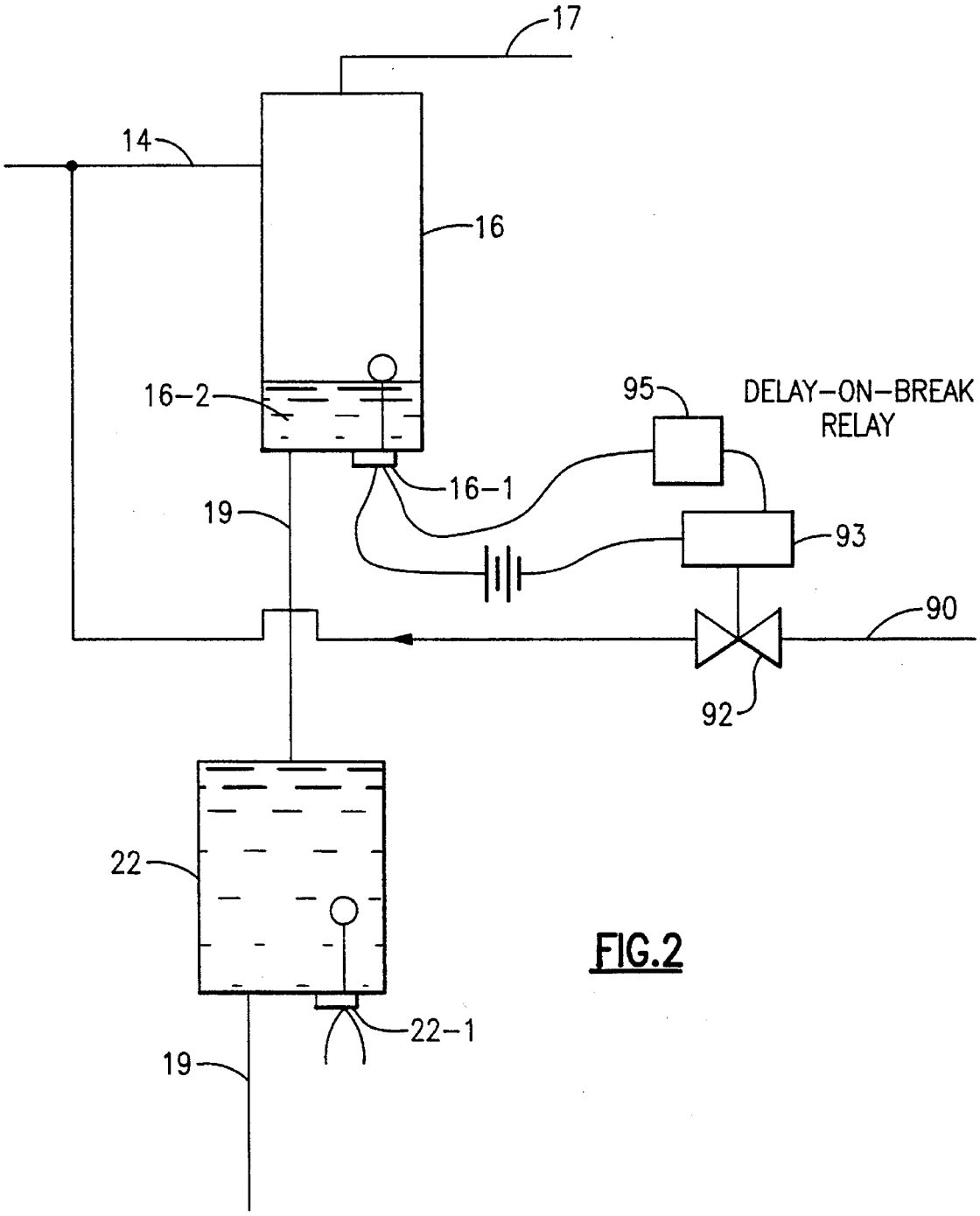
FIG. 2 is a schematic representation of the mid-stage oil system.

Turning now to FIG. 2, oil separator 16 has an oil float switch 16-1 and, similarly, oil reservoir 22 has an oil float switch 22-1. Oil float switch 22-1 is connected to the system safety circuit and disables the low stage compressors 12-1 to 12-4, on a safety responsive to insufficient oil for compressors 12-1 to 12-4 as indicated by too low of an oil level in oil reservoir 22. Oil removed from the refrigerant in oil separator 16 initially collects at the bottom of oil separator 16 in reservoir 16-2 whose level is tracked by the float switch 16-1. Oil drains from reservoir 16-2 via line 19 into oil reservoir 22 from which it serially passes to oil cooler 24 and to compressors 12-1 to 12-4.

Responsive to the sensing of too low of an oil level in oil reservoir 16-2 in oil separator 16 by switch 16-1, a circuit is completed to actuator 93 causing the opening of solenoid valve 92. The pressure differential between second stage and mid-stage pressures forces oil from the of oil reservoir 94 into line 90, through valve 92 to manifold 14 where it is mixed with the discharge gas flow from compressors 12-1 to 12-4, and is subsequently separated from the refrigerant gas in oil separator 16 as previously described. To prevent short cycling, it is desirable that a sufficient flow passes through valve 92. This may be achieved by having float switch 16-1 respond to a predetermined high oil level to cause the closing of valve 92 by disabling actuator 93 after the time delay of the delay-on-break relay 95 has expired. Also, there may be a predetermined timed flow through valve 92 whenever it is opened. From the foregoing description it should be clear that sufficient oil is returned to the first bank from the second bank when the oil level in the first bank drops sufficiently.

Although the present invention has been specifically described in terms of a system employing screw compressors other changes will occur to those skilled in the art such that it could also be applied to other systems such as those employing reciprocating compressors. It is therefore intended that the scope of the present invention is to be limited only by the scope of the appended claims.

What is claimed is:

1. In a refrigeration system serially including first compressor means for compressing refrigerant, first oil separator means for removing oil from refrigerant and returning oil removed by said first oil separator means to the first compressor means and for discharging refrigerant from which oil has been removed by said first oil separator means, second compressor means for further compressing said refrigerant from which oil has been removed by said first oil separator means, second oil separator means for removing oil from refrigerant and returning oil removed by said second oil separator means to said second compressor means and for discharging refrigerant from which oil has been removed by said second oil separator means which is delivered to a condenser and then subsequently divides into a plurality of paths each containing an expansion device and an evaporator with at least one path leading to said first compressor means and at least one path mixing with said refrigerant from which oil has been removed by said first oil separator means, oil control means comprising:

means for returning oil removed by said second oil separator means to said first oil separator means.

2. The oil control means of claim 1 wherein said means for returning oil removed by said second oil separator means to said first oil separator means includes:

a fluid path connecting said first and second oil separator means;

valve means in said fluid path;

means for causing opening of said valve means responsive to an oil loss from said first oil separator means to said second oil separator means.

3. The oil control means of claim 1 wherein said means for returning oil removed by said second oil separator means to said first oil separator means includes:

a fluid path connecting said first and second oil separator means;

valve means in said fluid path;

means for sensing oil level in said first oil separator means and for causing opening of said valve means responsive to sensing a predetermined oil level in said first oil separator means indicative of oil loss from said first oil separator means to said second oil separator means.

* * * * *